US007086255B2

(12) United States Patent
Reason

(10) Patent No.: US 7,086,255 B2
(45) Date of Patent: Aug. 8, 2006

(54) LOCKER BAG APPARATUS

(76) Inventor: William B. Reason, 47347 Silver Slate Dr., Lexington Park, MD (US) 20653

( * ) Notice: Subject to any disclaimer, the term of this patent is extended or adjusted under 35 U.S.C. 154(b) by 0 days.

(21) Appl. No.: 10/208,876

(22) Filed: Aug. 1, 2002

(65) Prior Publication Data

US 2004/0022455 A1 Feb. 5, 2004

(51) Int. Cl.
*E05B 69/02* (2006.01)
*B65D 33/14* (2006.01)

(52) U.S. Cl. ..... 70/2; 70/58; 70/59; 70/62; 70/68; 211/4; 248/552

(58) Field of Classification Search ..... 70/59, 70/60, 62, 68, 2, 3, 6, 61, 64, 76; 248/551–553, 248/914; 211/4; 383/22–24, 102, 103, 21, 383/37, 66, 95, 97, 6, 5, 25; 292/281; 150/101, 150/102, 107, 110; 190/100–102, 39, 115, 190/118, 903; 206/1.5, 278, 287; 24/429; 224/614

See application file for complete search history.

(56) References Cited

U.S. PATENT DOCUMENTS

| | | | | | |
|---|---|---|---|---|---|
| 605,343 | A | * | 6/1898 | Ross | 383/12 |
| RE14,225 | E | * | 12/1916 | Lowy | 190/115 |
| 2,897,863 | A | * | 8/1959 | Somers, Jr. | 383/22 |
| 3,554,256 | A | * | 1/1971 | Anderson | 604/408 |
| 4,286,444 | A | * | 9/1981 | Grudich | 70/13 |
| 4,792,073 | A | * | 12/1988 | Jacober | 224/614 |
| 5,154,459 | A | * | 10/1992 | Cochran | 292/258 |
| 5,560,083 | A | * | 10/1996 | Teixeira | 16/411 |
| 6,152,419 | A | * | 11/2000 | Bender | 248/551 |

* cited by examiner

*Primary Examiner*—Lloyd A. Gall

(57) ABSTRACT

The present invention is directed to a locker bag apparatus and system. The locker bag apparatus is preferably made of pliable or soft material and is provided with a zipper configured to lock with a locking hook, preferably a locking wall pole or tree hook.

3 Claims, 8 Drawing Sheets

LOCKER BAG APPARATUS

FIELD OF THE INVENTION

The present invention is directed to a locker bag apparatus. A preferred embodiment is a portable hanging locker bag made of pliable or flexible material for securing personal belongings to be used with a locking hook such as a wall or pole hook.

BACKGROUND OF THE INVENTION

Public athletic facilities, for example, in schools, colleges and universities and private athletic facilities such as health clubs usually include a locker room provided with individual lockers to allow persons using the facility to lock or secure their personal belongings while working out. Further, amusement or theme parks typically provide locking storage bins for personal items to be used by patrons who want to go on thrill rides or water park type rides and/or activities. Also, educational facilities (e.g. high schools) usually have hallway lockers for storing personal items, school supplies and/or materials, text books, musical instruments, and other items.

The current lockers are typically configured as connected units made of sheet metal having multiple compartments with locking doors which swing open and shut, and provided with a lock or arrangement to cooperate with a separate lock (e.g. padlock).

The conventional lockers are fairly expensive to purchase and install, take up a lot of space, and thus there usually is an inadequate number of these lockers at many athletic facilities. Further, a person utilizing such a locker on a non-exclusive basis must transfer their personal belongings into the locker during use, and remove such personal belongings after use. Thus, conventional lockers are somewhat inconvenient to use, especially if one desires to transport their personal belongings to and from the athletic facility on a regular basis.

The present invention is directed to overcome the expense and inconvenience of conventional lockers, and have other advantages and attributes over conventional lockers.

SUMMARY OF THE INVENTION

An object of the present invention is to provide an improved locker for personal belongings.

A second object of the present invention is to provide a portable locker bag apparatus.

A third object of the present invention is to provide a portable hanging locker bag apparatus.

A fourth object of the present invention is to provide a portable hanging locker bag apparatus for use with a locking hook such as a wall or pole hook.

A fifth object of the present invention is to provide a portable hanging locker bag apparatus made of pliable or flexible material.

A sixth object of the present invention is to provide a portable hanging locker bag apparatus including a reinforced handle and a zipper both configured to cooperate with a locking hook for securing the locker bag apparatus.

The present invention is directed to a locker bag apparatus itself, a locker bag apparatus according to the present invention in combination with a locking hook such as a wall or pole hook, a locker bag according to the present invention in combination with a locking wall hook according to the present invention, and a locker bag system including a plurality of locker bag apparatus and/or locking hooks according to the present invention.

The locker bag apparatus according to the present invention is preferably portable, and can be carried in the hand, on the shoulder or back of an individual to and from an athletic facility. The personal belongings of the individual, for example, are packed at the individual's residence and carried by the individual to the recreational facility. After use, the individual then carries his or her personal belongings back to their residence.

The locker bag apparatus according to the present invention is also preferably configured to be a hanging locker bag apparatus. Specifically, the locker bag apparatus is configured to be hung, for example, by providing a handle preferably in an upper portion of the locker bag apparatus. The portable hanging locker bag apparatus according to the present invention is preferably provided with at least one interior compartment and at least one zipper or other type of sliding resealable closure to provide access to at least one compartment within the portable hanging locker bag apparatus. Preferably, the zipper is a heavy duty plastic or metal teeth type zipper having some measure of strength to prevent intentional breaking or otherwise tampering thereof. In a preferred embodiment, the zipper is configured to be locked closed. In a more preferred embodiment, the zipper is provided with a sliding tab having a ring portion, which together with the handle of the portable hanging locker bag apparatus is locked closed when placed on a locking hook according to the present invention.

The zipper is preferably provided in a front panel of the locker bag and oriented in a substantially vertical direction. Further, preferably the zipper is arranged so that the zipper is open when the sliding tab is located at a lower position and is closed when the sliding tab is pulled to an upper position so that a ring of the sliding tab is positioned adjacent to the handle of the locker bag apparatus according to the present invention. In one embodiment, the zipper begins at the lowest position of the front panel of the locker bag apparatus, however, more preferably, the zipper begins at a position above a lower edge of the front panel so that the entire front panel cannot be opened. In this manner, shoes and other personal belongings located in a lower portion of the portable bag apparatus cannot easily fall out of the locker bag apparatus when fully opened by the zipper due to the lower front panel of the locker bag apparatus remaining fixed or closed and acting as a tray type support.

The locker bag apparatus according to the present invention can be provided with multiple compartments such as providing pockets, containers, envelopes, pouches, dividers (e.g. vertical and/or horizontal) or other structure for dividing up the internal space of the locker bag apparatus. The locker bag apparatus can include additional zippers, buttons, Velcro, snaps or other suitable resealable mechanical fasteners for opening and closing various compartments from the outside and/or inside of the locker bag apparatus.

Preferably, the locker bag apparatus according to the present invention is provided with one or more vents to allow circulation of air within the locker bag apparatus. Preferably, a vent is provided in an upper portion of the locker bag apparatus to allow venting of the air from within the locker bag apparatus. In a preferred embodiment, a pair of vents defined by screen-like material (e.g. nylon screen) is provided in an upper portion of the locker bag apparatus on either side of a vertically oriented zipper.

The locker bag apparatus is preferably made of pliable or flexible or "soft" material, preferably a high strength fabric or textile material such as nylon, polyester and other suitable polymers or blends of materials. However, leather or synthetic leather can be suitable in some applications such as one or more panels or components of the locker bag apparatus according to the present invention. The use of high strength fabric material results in a light weight, strong, durable and somewhat theft proof locker bag apparatus. The locker bag apparatus can be reinforced with internal layers or sheets of material (e.g. plastic sheeting or metal layers or sheeting). The reinforcing layers can be located internal of the locker bag apparatus or located within layers of materials during the manufacture of the material and/or construction or assembly of the locker bag apparatus. For example, a substantially rigid plastic panel is inserted within the bottom of the locker bag apparatus to provide rigidity and reinforcement to the bottom fabric panel of the locker bag apparatus. Alternatively, a plastic tray is placed within the bottom of the fabric locker bag apparatus to reinforce the lower portion of the locker bag apparatus to prevent collapse thereof, and to provide a more secure support for shoes and other items to be stacked up within the locker bag apparatus. Preferably, the locker bag apparatus is provided with a vertical reinforcement structure such as a substantially rigid panel, rod, sheet or cage to maintain the height dimension of a flexible or soft locker bag apparatus.

The locker bag apparatus according to the present invention can include one or more handles. Preferably, a reinforced handle is provided in an upper portion of the bag to allow hanging of the locker bag apparatus. Preferably, the handle is reinforced with additional reinforcing layers, components and/or members provided within the handle such as layers of Kevlar strands, Kevlar fabric, Kevlar rope, graphite fibers or strands, fiberglass or composite rod(s), fiberglass or composite plate(s), plastic stiffener, one or more metal strips or wires, plastic or wire mesh or netting and/or tubing. Additional handles can be provided to allow gripping of the locker bag apparatus during transporting, loading or mounting the locker bag apparatus on a locking hook according to the present invention. The handle can be secured by mechanical fasteners (e.g. plastic or metal rivets, clips), adhesive glue, welding, fusing, sewn, weaving and/or other types of physical or mechanical fastening.

The locker bag apparatus according to the present invention is preferably a portable hanging locker bag apparatus. Specifically, preferably the locker bag apparatus according to the present invention is configured to be both portable and configured to hang from a support (e.g. hanging tree or pole) or wall (e.g. wall hook). The locker bag apparatus can be used with a conventional wall hook (i.e. no locking means), or preferably is utilized with a locking wall hook. Most preferably, the locker bag apparatus according to the present invention is utilized with the locking wall hook according to the present invention.

The locking wall hook according to the present invention is configured to be attached or mounted on a wall in the athletic facility. For example, the wall can be made of gypsum board, and the locking hook according to the present invention can be anchored to the wall utilizing conventional wall hook anchors. Alternatively, the wall can be plaster or a masonry wall (e.g. cement block wall), and appropriate plaster or cement block wall anchors are utilized for mounting the locking wall hook according to the present invention to the plaster or cement block wall. The locking wall hook according to the present invention can be configured to utilize a combination lock (e.g. key type or combination type), or alternatively, the locking wall hook is provided with an integral lock (e.g. key type or combination type or electronic keypad type). It is desirable that the locking wall hook according to the present invention is configured so that the locker bag apparatus can be hung on the locking wall hook and suspended prior to locking the locking wall hook. Thus, a person would not need to hold up the locker bag apparatus with one hand while attempting to lock the locking hook with the other hand. In this manner, a user will have both hands free for the purpose of closing and locking the wall hook after the locker bag apparatus has been hung from the locking wall hook to provide convenience and make it easier to lock the locking wall hook.

The present invention is also directed to a system utilizing a plurality of locker bag apparatus according to the present invention in combination with a plurality of locking hooks, preferably locking hooks according to the present invention. For example, a plurality of locking wall hooks according to the present invention can be mounted on a wall in a row and/or column or matrix (i.e. both rows and columns). In this manner, the number and density of the locker bag apparatus to be stowed on a particular wall area can be greatly increased reducing the capital cost in designing and constructing the athletic facility, or having an existing recreation facility retrofitted to utilize the locker bag apparatus according to the present invention. Preferably, the locking wall hooks are equally spaced in rows and/or columns with sufficient spacing to allow easy and convenient hanging of the locker bag apparatus, or use thereof especially in a crowded recreational facility.

In use, a user arriving at the recreation facility hangs his or her locker bag apparatus on an existing locking wall hook, and then accesses the locker bag apparatus for obtaining athletic clothing or wear. Then, the user stows his or her street clothing, valuables and other personal possessions within the locker bag apparatus, and then proceeds to lock the zipper closed and the handle with the locking wall hook. These personal belongings remain somewhat secure while the person proceeds to work out, shower and get ready to exit the recreation facility. The user then unlocks the locking wall hook, opens the locker bag apparatus and makes a change of clothing, and then exits the recreation facility with the portable locker bag apparatus in his or her hand, or over his or her shoulder or back.

DETAILED DESCRIPTION OF PREFERRED EMBODIMENTS

Figure 1:
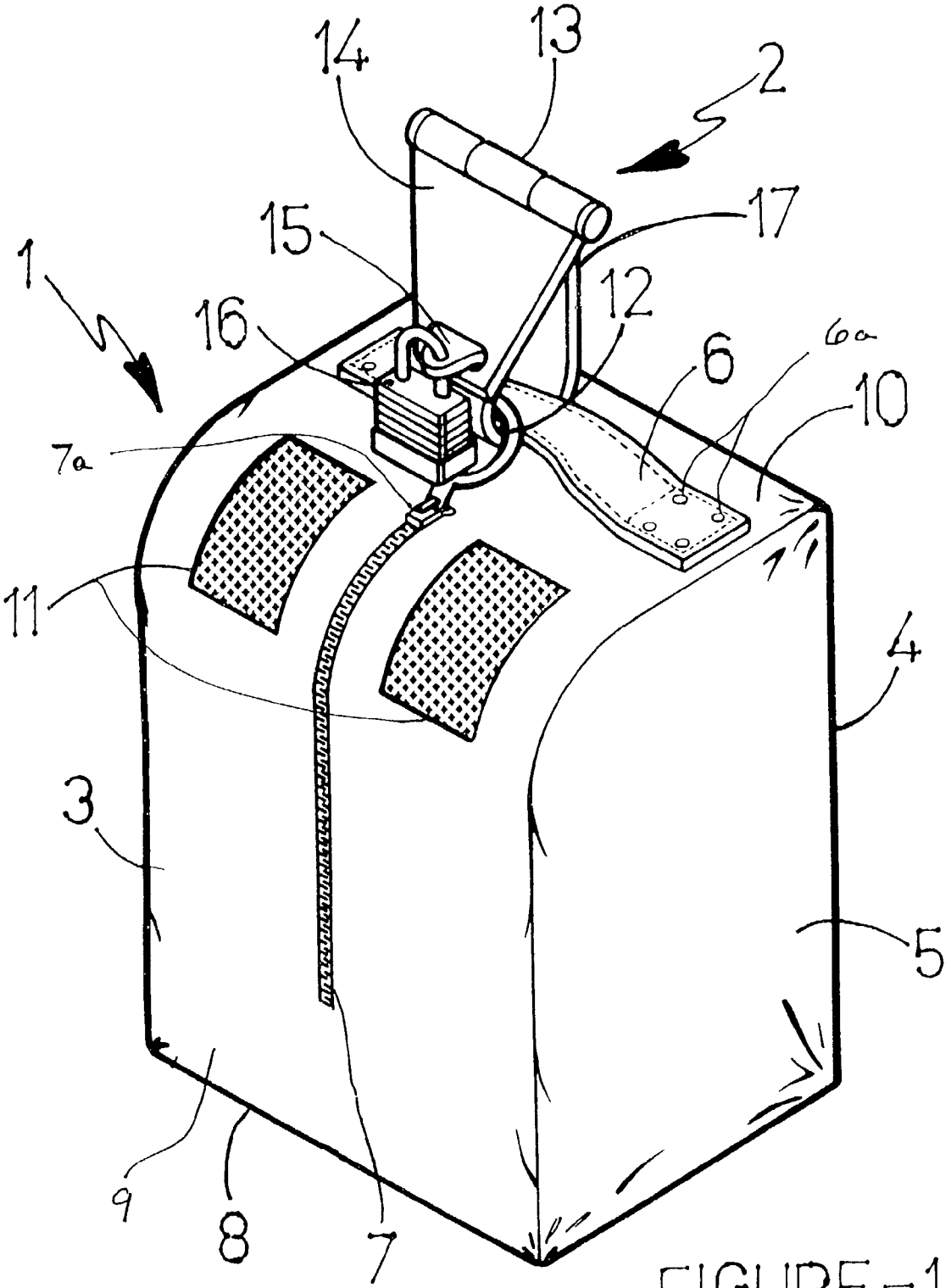
FIG. 1 is a perspective view of a preferred embodiment of the locker bag apparatus according to the present invention.

A preferred locker bag apparatus 1 according to the present invention is shown in FIGS. 1–4.

The locker bag apparatus 1 is made of pliable or flexible or "soft" material, preferably a woven fabric material such as nylon or polyester fabric or blend.

The locker bag apparatus 1 includes a front panel 3 extending upwardly which also defines a top panel of the locker bag apparatus 1. The front panel 3 and back panel 4 are connected together by side panels 5. A handle 6, preferably reinforced with a metal strip disposed therein, is connected by two (2) sets of rivets 6*a* to an upper portion of the locker bag apparatus 1. A zipper 7 is provided in the center of the front panel 3 and oriented in a substantially vertical direction as shown. The bottom end of the zipper 7 is located a distance above the bottom panel 8 of the locker bag apparatus 1. In this manner, even with the zipper 7 fully opened, a lower portion of the locker bag apparatus 1 defines an inner support tray for shoes and other personal belongings in the lower portion 9 of the locker bag apparatus 1.

To provide air circulation and venting within the locker bag apparatus 1, a pair of vents 11, made of, for example, fabric (e.g. nylon netting) are provided in upper portion 10 of the locker bag apparatus 1. The zipper 7 is provided with a slide portion 7*a* including a ring portion 12.

The locking wall hook 2 includes a hinge portion 13 with a movable locking plate 14 connected thereto. The locking plate 14 cooperates with a locking extension 15 extending through the locking plate 14, and secured in position with padlock 16. The locking extension 15 is a portion of the wall mounting plate 17. With the padlock 16 removed, the locking plate 14 can be lifted upwardly via the hinge portion 13 to allow removal of the locker bag 1 from the locking wall hook 2.

Figure 2:
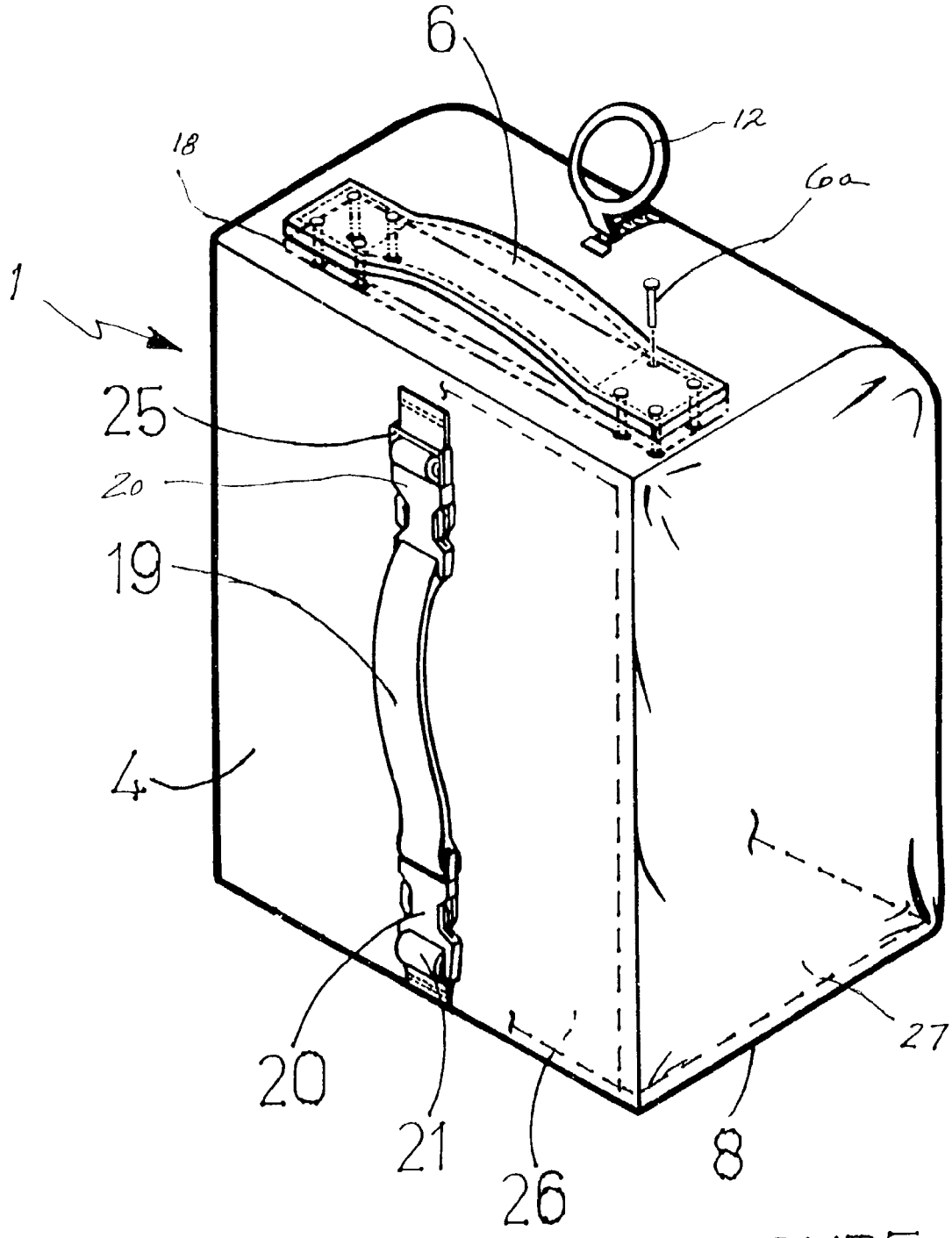
FIG. 2 is a perspective rear view of the locker bag apparatus shown in FIG. 1.
Figure 3:
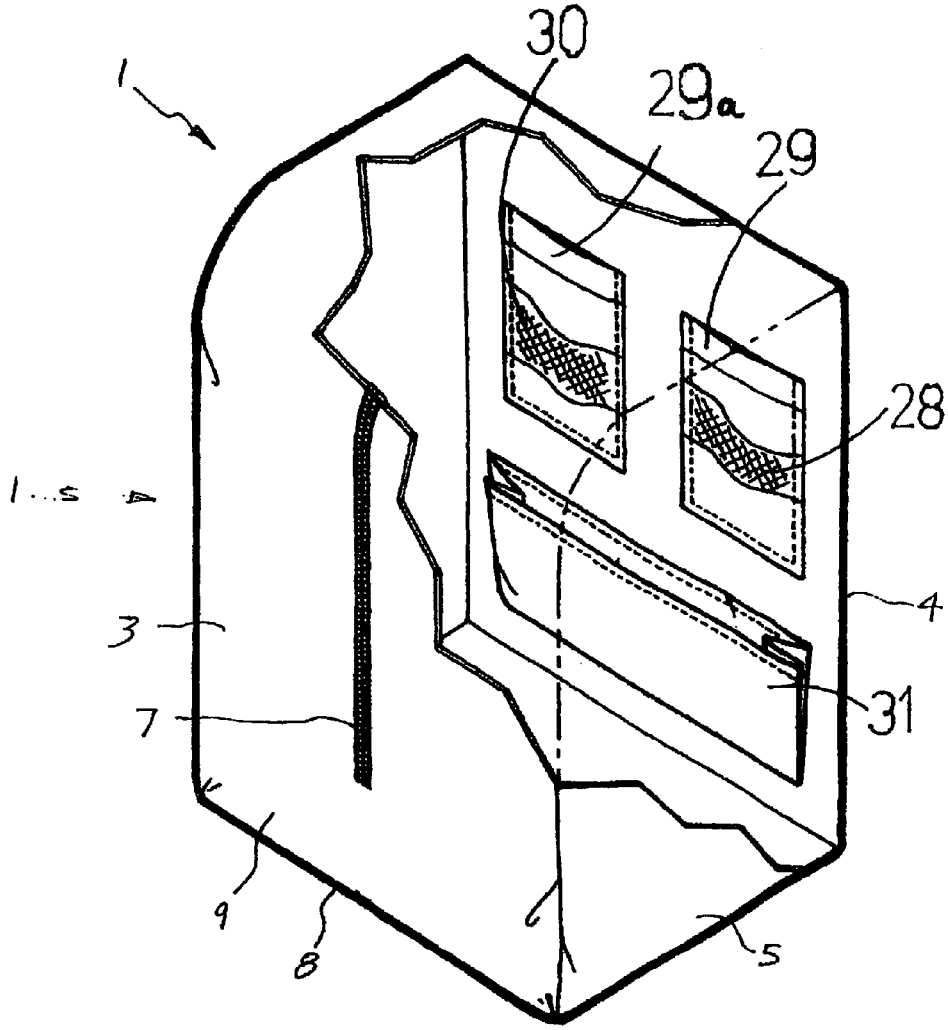
FIG. 3 is a broken away perspective view of the locker bag apparatus shown in FIGS. 1 and 2.

As shown in FIG. 2, a separate metal strip 18 is provided within the locker bag apparatus 1 to which the sets of rivets 6*a* are connected thereto. In this manner, the handle 6 is further reinforced against being detached intentionally or through tampering while being hung on the locking wall hook 2 (FIG. 1).

The locker bag apparatus 1 optionally can be provided with a detachable and adjustable shoulder strap 19 via snap clip 20 and connection portion 21. An upper portion of the shoulder strap 19 is provided with another snap clip 20 connected to the locker bag apparatus 1 via strap adjuster 25. The back panel 4 of the locker bag 1 is reinforced by providing a substantially stiff inner panel 26 (e.g. made of plastic resin) and the bottom panel of the locker bag apparatus 1 is reinforced by an inner substantially rigid panel 27 (e.g. made of plastic resin) as shown in FIG. 2. The locker bag apparatus 1 optionally can be provided with personal belonging holders 29 and 29*a* having elastic bands 28 and 30 for securing personal belongings, such as combs or brushes within the locker bag apparatus 1. Further, an optional pouch 31 again for holding personal belongings can be provided within the locker bag apparatus 1.

Figure 4:
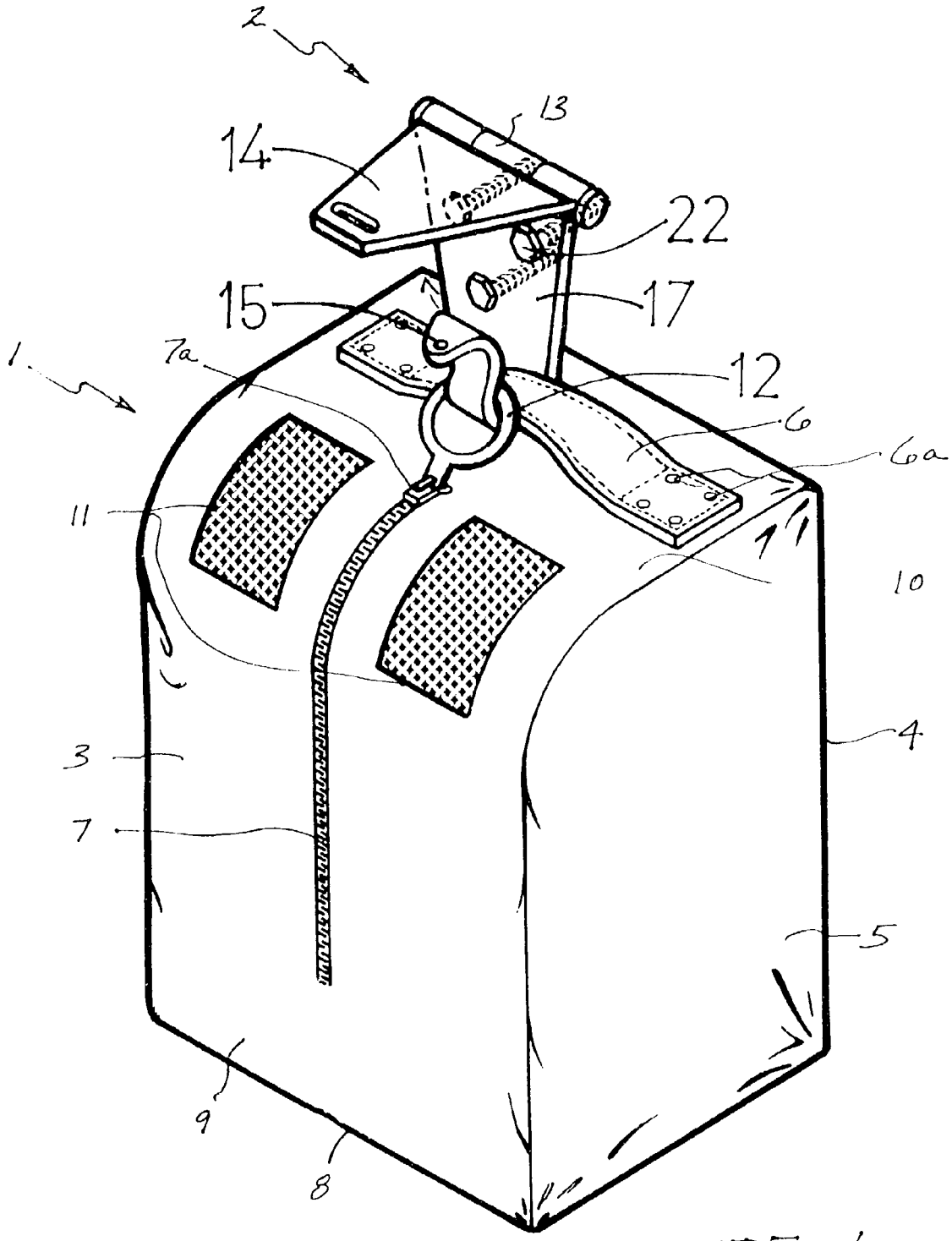
FIG. 4 is a perspective view of the locker bag apparatus shown in FIGS. 1–3.

As shown in FIG. 4, the locking wall hook 2 can be secured to a wall, tree, pole or other vertical support using three (3) bolts 22.

In use, a person or individual places the locker bag apparatus 1 onto the locking wall hook 2, as shown in FIG. 4, to hang the locker bag apparatus 1. Then, the person opens the locker bag apparatus 1 by opening the zipper 7. The person can then access the personal belongings stowed within the locking bag apparatus 1 to allow removal of the personal belongings contained therein. Upon changing into his or her athletic clothing, the person places his or her street clothing and assorted personal belongings into the locker bag apparatus 1, closed the zipper 7 and placed the ring portion 12 over the locking extension 15 of the locking wall hook 2, and then lowers the locking plate 14 down over the locking extension 15 as shown in FIG. 1. The padlock 16 securely locks the handle 6 and ring portion 12 of zipper 7 of the locker bag apparatus 1 within the locking wall hook 2.

Figure 5:
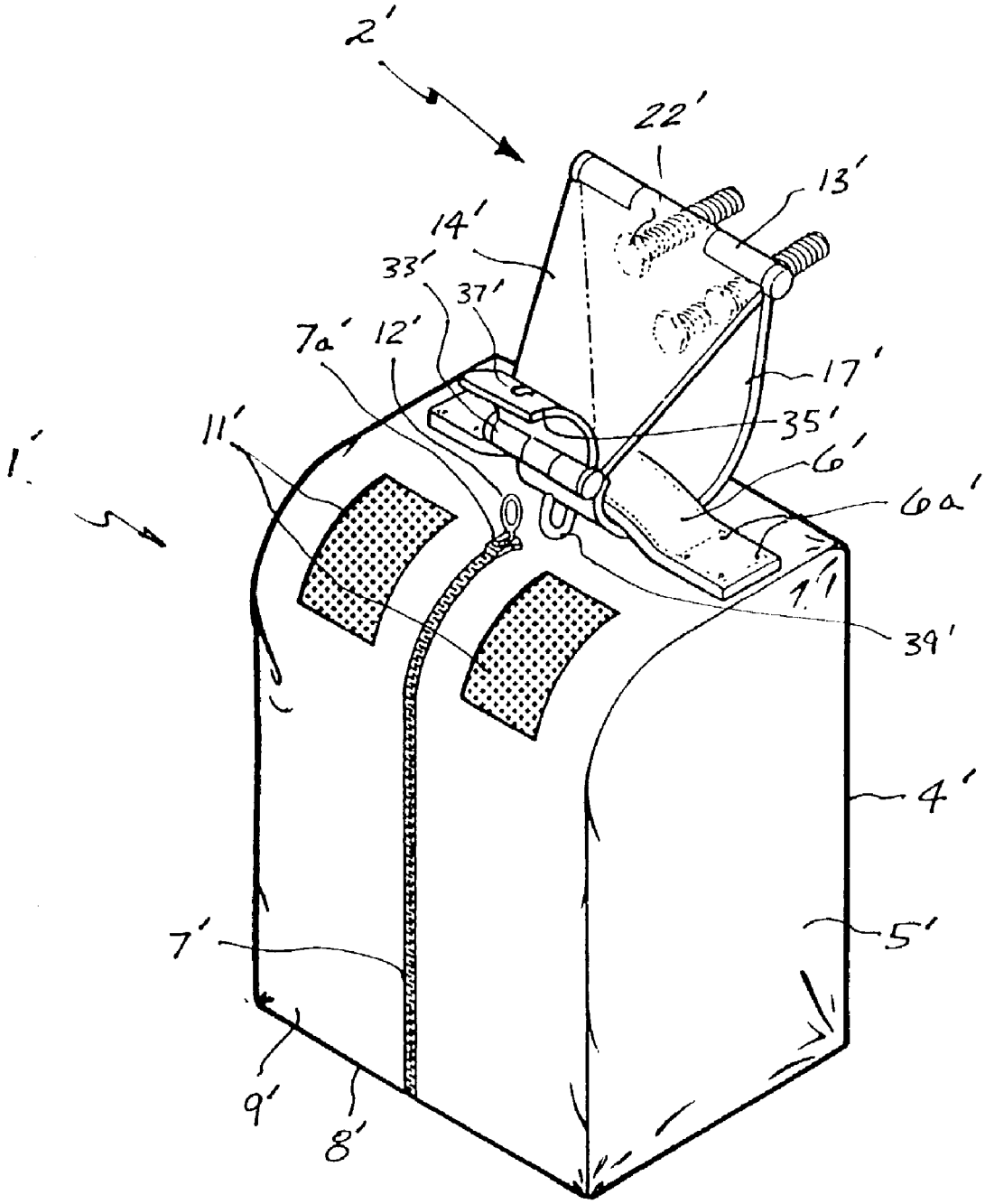
FIG. 5 is a perspective view of another embodiment of the locker bag apparatus according to the present invention with the lock in an open position.
Figure 6:
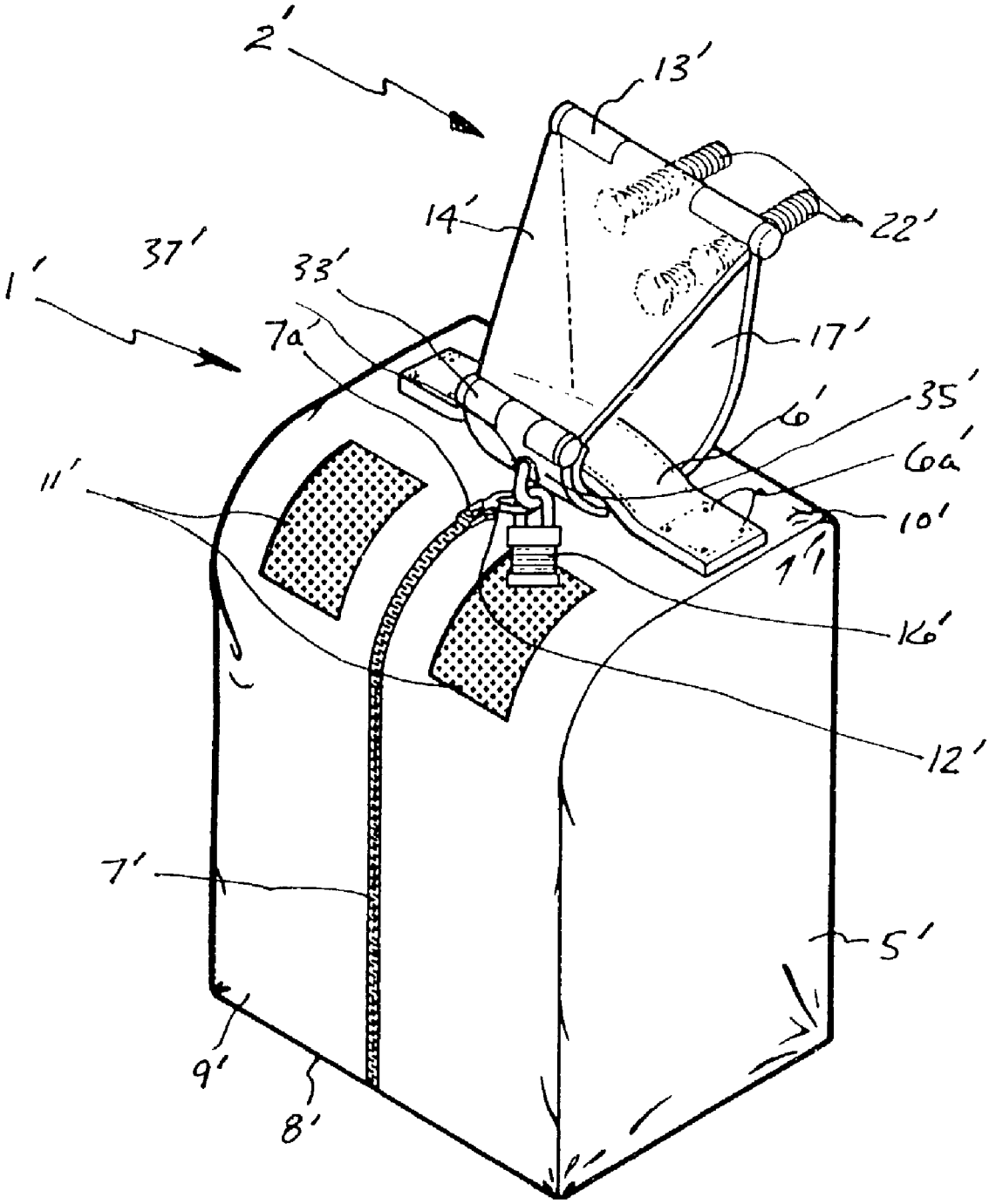
FIG. 6 is a perspective view of the locker bag apparatus shown in FIG. 5, however, with the lock in a closed position.

Another embodiment of the locker bag apparatus 1' according to the present invention is shown in FIGS. 5 and 6.

The locker bag apparatus 1' shown in FIG. 5 is essentially the same embodiment of the locker bag apparatus 1 shown in FIG. 1, however, the zipper 7' extends all the way down to the bottom edge of the front panel 3. This allows additional access to the interior of the locker bag 1'.

Further, the locking wall hook 2' is similar to the locking wall hook 2 shown in FIG. 1, however, the locking plate 14' is provided with an additional hinge portion 33' connecting a cover portion 35' provided with a slot 37' for accommodating locking loop 39' connected to wall mounting plate 17'. In this manner, the padlock 16', as shown in FIG. 6, is located somewhat below the locking wall hook 2' to reduce the likelihood of injury in the event a person fell into or against the locking wall hook 2'.

Figure 7:
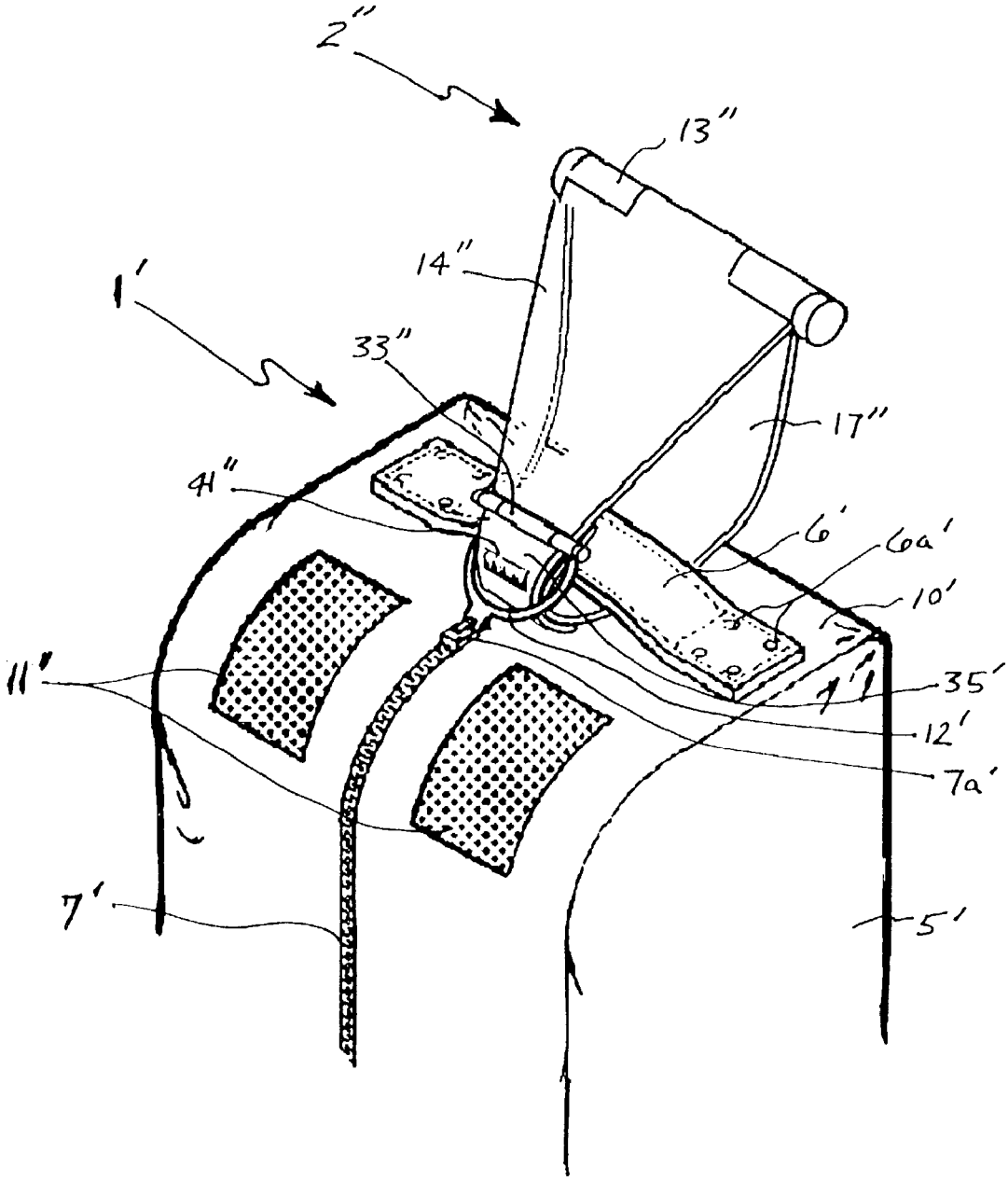
FIG. 7 is a perspective view of a further embodiment of the locker bag apparatus according to the present invention utilizing an integral combination lock with the locking wall hook.
Figure 8:
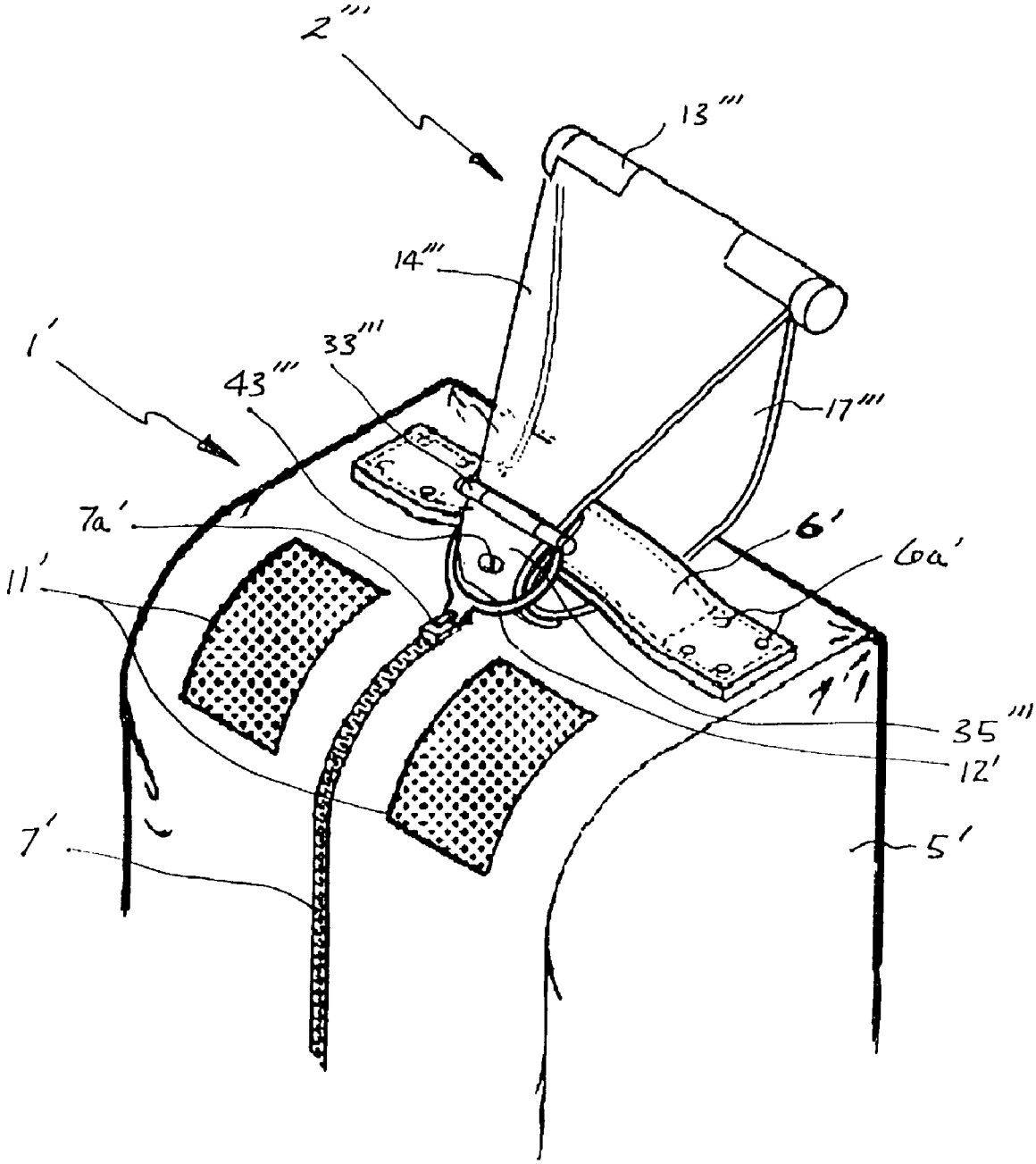
FIG. 8 is a perspective view of an even further embodiment of the locker bag apparatus according to the present invention utilizing an integral keyed locked with the locking wall hook.

Two (2) additional embodiments of the locker bag apparatus according to the present invention is shown in FIGS. 7 and 8.

The locking wall hook 2", as shown in FIG. 7 is essentially the same as the locking wall hook 2' shown in FIG. 6 except the padlock 16' has been replaced with a combination lock 41" assembled within or integral with the cover portion 35'.

In the embodiment shown in FIG. 8, the locking wall hook 2'" is essentially the same as the locking wall hook 2' shown in FIG. 6, however, the combination lock 16' has been replaced with a keyed lock 43'" assembled within or integral with the cover portion 35'".

What is claimed is:

1. A locker bag system for securing a bag to a surface, said system comprising:

a locker bag for being vertically suspended along a longitudinal axis, said bag including a handle at a top portion, and a slide fastener extending along a vertical surface and movable towards said handle; and a lockable hook assembly for attachment to a surface, said hook assembly including an inner plate portion selectively engagable with said slide fastener, and an outer plate portion hinged to said inner plate portion and including a slot to receive an extension of said inner plate portion, wherein said extension is capable of receiving a padlock.

2. A system according to claim 1, wherein said slide fastener includes a ring for engaging said inner plate portion.

3. A system according to claim 1, wherein said hook assembly includes at least one fastener for securing said hook assembly to a surface.

* * * * *